US008480077B2

(12) United States Patent
Dunn et al.

(10) Patent No.: US 8,480,077 B2
(45) Date of Patent: Jul. 9, 2013

(54) DOCUMENT PROCESSING APPARATUS AND METHOD OF OPERATING A DOCUMENT PROCESSING APPARATUS

(75) Inventors: Frank B. Dunn, Waterloo (CA); Gary R. Marshall, Waterloo (CA)

(73) Assignee: NCR Corporation, Duluth, GA (US)

( * ) Notice: Subject to any disclaimer, the term of this patent is extended or adjusted under 35 U.S.C. 154(b) by 128 days.

(21) Appl. No.: 12/608,424

(22) Filed: Oct. 29, 2009

(65) Prior Publication Data

US 2011/0101595 A1 May 5, 2011

(51) Int. Cl.
*B65H 29/66* (2006.01)
*B65H 5/34* (2006.01)

(52) U.S. Cl.
USPC ..... 271/202; 271/270

(58) Field of Classification Search
USPC ..... 271/202, 270, 207
See application file for complete search history.

(56) References Cited

U.S. PATENT DOCUMENTS

| | | | | |
|---|---|---|---|---|
| 4,015,701 | A * | 4/1977 | Templeton | 400/611 |
| 6,170,820 | B1 * | 1/2001 | Hutson | 271/274 |
| 6,499,734 | B1 * | 12/2002 | Tranquilla | 271/10.03 |
| 6,554,275 | B1 * | 4/2003 | Tranquilla | 271/259 |
| 6,685,184 | B2 * | 2/2004 | Tufekci et al. | 271/270 |
| 6,792,332 | B1 * | 9/2004 | DePoi | 700/213 |
| 7,040,616 | B2 * | 5/2006 | Stemmle | 271/270 |
| 7,383,016 | B2 * | 6/2008 | Lee et al. | 399/400 |
| 7,568,696 | B2 * | 8/2009 | Henson | 271/270 |
| 2008/0258380 | A1 * | 10/2008 | Okumura et al. | 271/258.01 |

* cited by examiner

*Primary Examiner* — Patrick Cicchino
(74) *Attorney, Agent, or Firm* — Michael Chan

(57) ABSTRACT

A document processing apparatus comprises a document transport path which extends from an upstream end to a downstream end, a low speed drive disposed at the upstream end of the document transport path and for transporting a document along the document transport path from the upstream end towards the downstream end, a high speed drive disposed at the downstream end of the document transport path and for receiving a document being transported along the document transport path from the low speed drive, an actuatable document processing device disposed at the downstream end of the document transport path and for, when actuated, performing a downstream processing operation on a document being transported along the document transport path, a sensor for (i) sensing speed of movement of a document which is being transported along the document transport path from the upstream end to the downstream end, and (ii) providing a first electrical signal which is indicative of speed of movement of the document, and a controller for (i) monitoring the first electrical signal to thereby monitor speed of movement of the document along the document transport path, (ii) detecting when speed of movement of the document has increased from a first speed to a second speed which is greater than the first speed, (iii) providing a second electrical signal to actuate the document processing device to perform the downstream processing operation in response to detection of speed of movement of the document having increased from the first speed to the second speed.

10 Claims, 8 Drawing Sheets

DOCUMENT PROCESSING APPARATUS AND METHOD OF OPERATING A DOCUMENT PROCESSING APPARATUS

BACKGROUND

The present invention relates to document processing along a document transport path, and is particularly directed to a document processing apparatus and method of operating a document processing apparatus.

In some known document feeding mechanisms, there is a need to detect a gap between adjacent documents (i.e., a leading document and a trailing document) which are being fed from an upstream end of a document transport path to a downstream end of the document transport path. In these known document feeding mechanisms, an upstream-located low speed drive transports the leading document along the document transport path until the leading edge of the leading document reaches and engages a downstream-located high speed drive. When the leading edge of the leading document engages the high speed drive, the high speed drive operates to separate the leading document away from the trailing document which is just behind the leading document. As the leading document separates away from the trailing document, a gap is created between the trailing edge of the leading document and the leading edge of the trailing document.

A sensor is positioned along the document transport path to detect presence of the gap formed between the leading and trailing documents. The sensor provides an electrical signal when a gap of sufficient size is detected between the trailing edge of the leading document and the leading edge of the trailing document. Detection of the gap indicates that the leading document has separated away from the low speed drive and that downstream operations (such as aligning the document) can now begin.

A drawback in using gap detection for the purpose of indicating when the leading document is free of the low speed drive is that the size of the gap needs to be large enough so that the sensor can detect presence of the gap. When a relatively large gap is needed, a relatively long document transport path is needed. This is because a document will need to move farther downstream along the document transport path in order to create the relatively large gap. Accordingly, even though a document may be free of the low speed drive, downstream operations cannot begin until a gap of at least a certain size is created between adjacent documents so that the sensor can detect presence of this gap. It would be desirable to provide a way of detecting when a document is free of the low speed drive, without having to wait for a gap of at least a certain size to be created between adjacent documents, so that downstream operations can begin immediately upon detection that the document is free of the low speed drive.

SUMMARY

In accordance with one embodiment of the present invention, a document processing apparatus comprises a document transport path which extends from an upstream end to a downstream end, a low speed drive disposed at the upstream end of the document transport path and for transporting a document along the document transport path from the upstream end towards the downstream end, a high speed drive disposed at the downstream end of the document transport path and for receiving a document being transported along the document transport path from the low speed drive, an actuatable document processing device disposed at the downstream end of the document transport path and for, when actuated, performing a downstream processing operation on a document being transported along the document transport path, a sensor for (i) sensing speed of movement of a document which is being transported along the document transport path from the upstream end to the downstream end, and (ii) providing a first electrical signal which is indicative of speed of movement of the document, and a controller for (i) monitoring the first electrical signal to thereby monitor speed of movement of the document along the document transport path, (ii) detecting when speed of movement of the document has increased from a first speed to a second speed which is greater than the first speed, (iii) providing a second electrical signal to actuate the document processing device to perform the downstream processing operation in response to detection of speed of movement of the document having increased from the first speed to the second speed.

DETAILED DESCRIPTION

Figure 1:
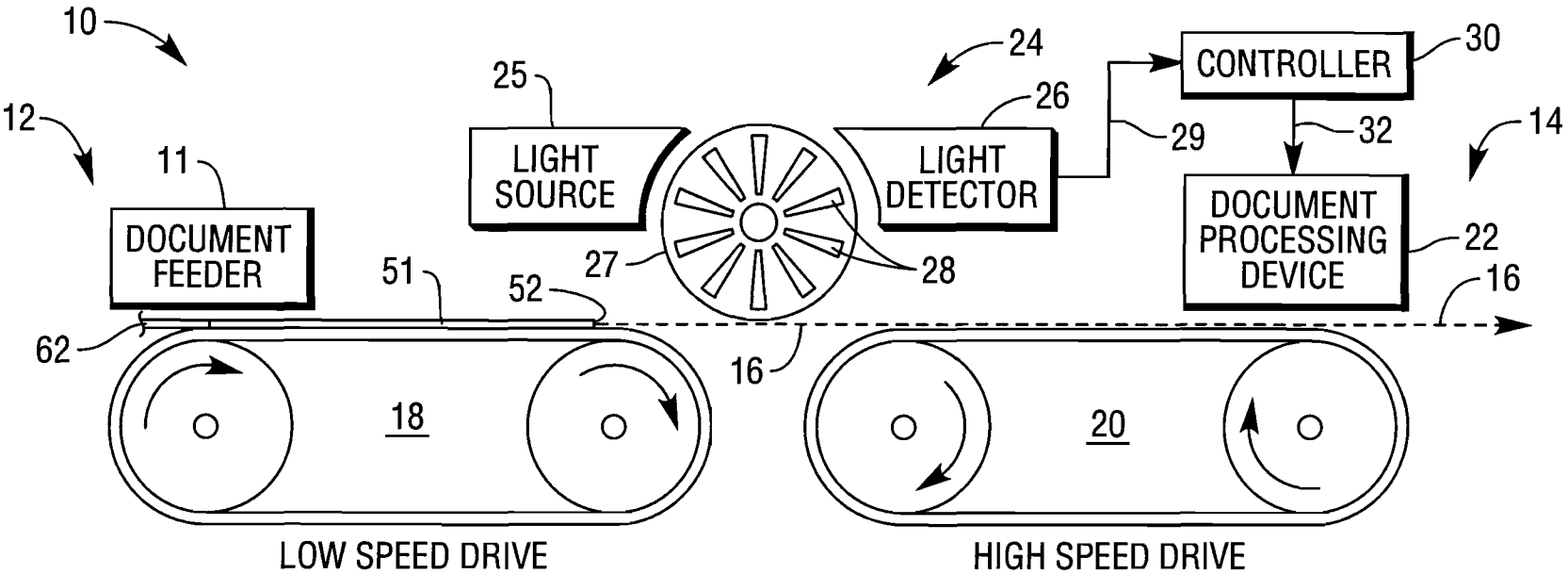
FIG. 1 is a schematic view of a document processing apparatus constructed in accordance with one embodiment of the present invention.

The present invention is directed to a document processing apparatus and method of operating a document processing apparatus. The specific use and construction of the document processing apparatus may vary. By way of example, a document processing apparatus 10 constructed in accordance with one embodiment of the present invention is illustrated in FIG. 1.

The document processing apparatus 10 has an upstream end 12, a downstream end 14, and a document transport path 16 extending between the upstream end and the downstream end. The document processing apparatus 10 includes a document feeder 11 from which documents are picked and fed onto the document transport path 16. Structure and operation of the document feeder 11 are conventional and, therefore, will not be described.

The document processing apparatus 10 also includes a low speed drive 18 disposed at the upstream end 12 of the document transport path 16. The low speed drive 18 typically includes a number of drive belts and drive rollers (such as shown in FIG. 1) which cooperate together to transport a document along the document transport path from the upstream end 12 towards the downstream end 14 of the document transport path. As shown in FIG. 1, the low speed drive 18 is transporting a first document 51 (i.e., a leading document) along the document transport path 16. A second document 62 (i.e., a trailing document) follows and is adjacent to the first document 51 along the document transport path 16.

The document processing apparatus 10 further includes a high speed drive 20 disposed at the downstream end 14 of the document transport path 16. The high speed drive 20 receives a document being transported along the document transport path 16 from the low speed drive 18. The high speed drive 20 also typically includes a number of drive belts and drive rollers which cooperate together to transport the document further downstream for further processing by an actuatable document processing device 22 disposed at the downstream end 14 of the document transport path 16. Belts of the low speed drive 18 have a relatively higher coefficient of friction than coefficient of friction of belts of the high speed drive 20.

When actuated, the document processing device 22 performs a downstream processing operation on a document which has been transported through both the low speed drive 18 and the high speed drive 20 along the document transport path 16. For example, the device 22 may comprise an alignment device for aligning a document which is being transported along the document transport path 16.

The document processing apparatus also includes a sensor 24 which is disposed between the low speed drive 18 and the high speed drive 20. The sensor 24 senses speed of movement of a document which is being transported along the document transport path 16 from the upstream end 12 to the downstream end. The sensor 24 is in the form of a surface motion sensor which provides an electrical signal indicative of speed of movement of the surface of a document which is being transported along the document transport path 16.

As shown in FIG. 1, one type of surface motion sensor comprises a light source 25, a light detector 26, and an optical wheel 27 having a number of radially-extending slits 28 through which light from the light source can be transmitted. Light pulses transmitted through slits 28 by light detector 26 are usually counted, and the number of light pulses counted during a predetermined period of time corresponds to speed of movement of the document being transported along the document transport path 16 from the upstream end 12 to the downstream end 14.

The sensor 24 provides a first electrical signal on line 29 which is indicative of the number of light pulses counted over the predetermined period of time. Accordingly, the first electrical signal on line 29 from the sensor 24 is indicative of the speed of movement of the document being transported along the document transport path 16 from the upstream end 12 to the downstream end 14. Structure and operation of the surface motion sensor 24 are known and, therefore, will not be described further.

A controller 30 monitors the first electrical signal on line 29 from the sensor 24, and thereby monitors speed of movement of a document along the document transport path 16. Upon detection of speed of movement of a document increasing from a first speed to a second speed which is greater than the first speed, the controller 30 provides a second electrical signal on line 32 in response thereto. The second electrical signal on line 32 is applied to the document processing device 22 to actuate the device. When actuated, the document processing device 22 performs a downstream processing operation. For example, if the document processing device 22 comprises an actuatable aligning device, then the second electrical signal on line 32 actuates the alignment device to begin alignment of the document being transported along the document transport path 16.

Figure 2:
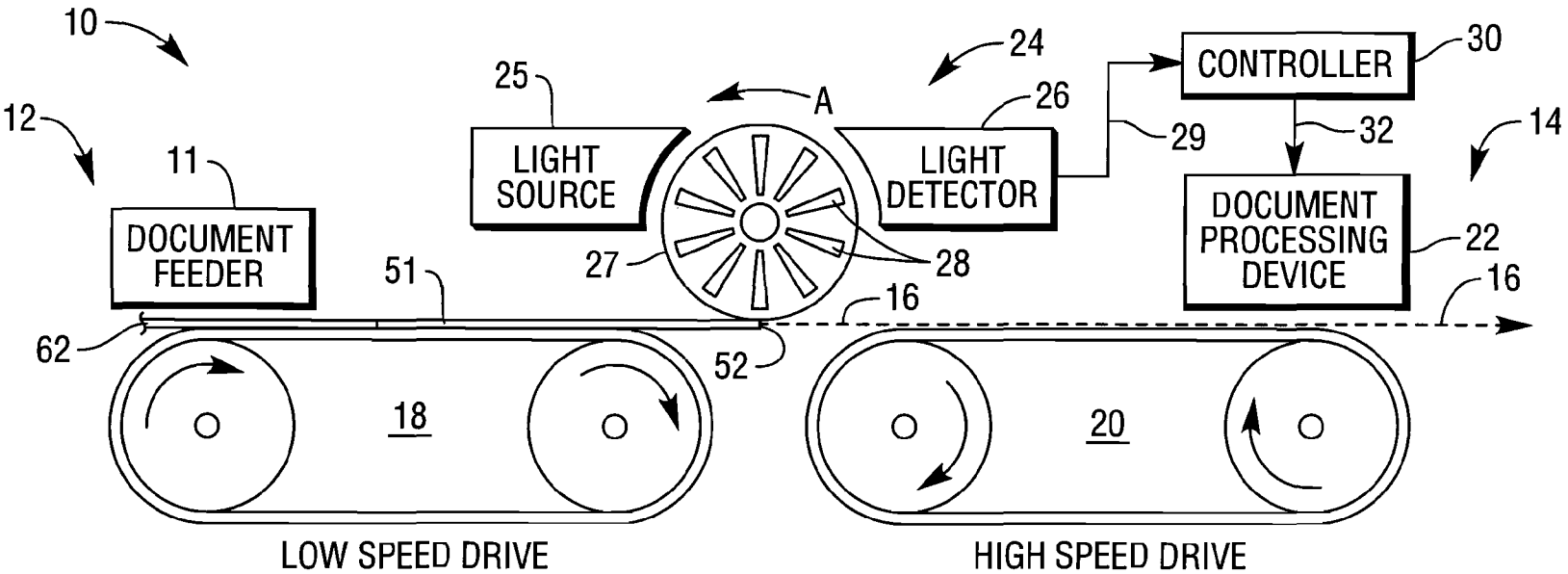
FIGS. 2-8 are views similar to FIG. 1 and showing documents in different positions.
Figure 3:
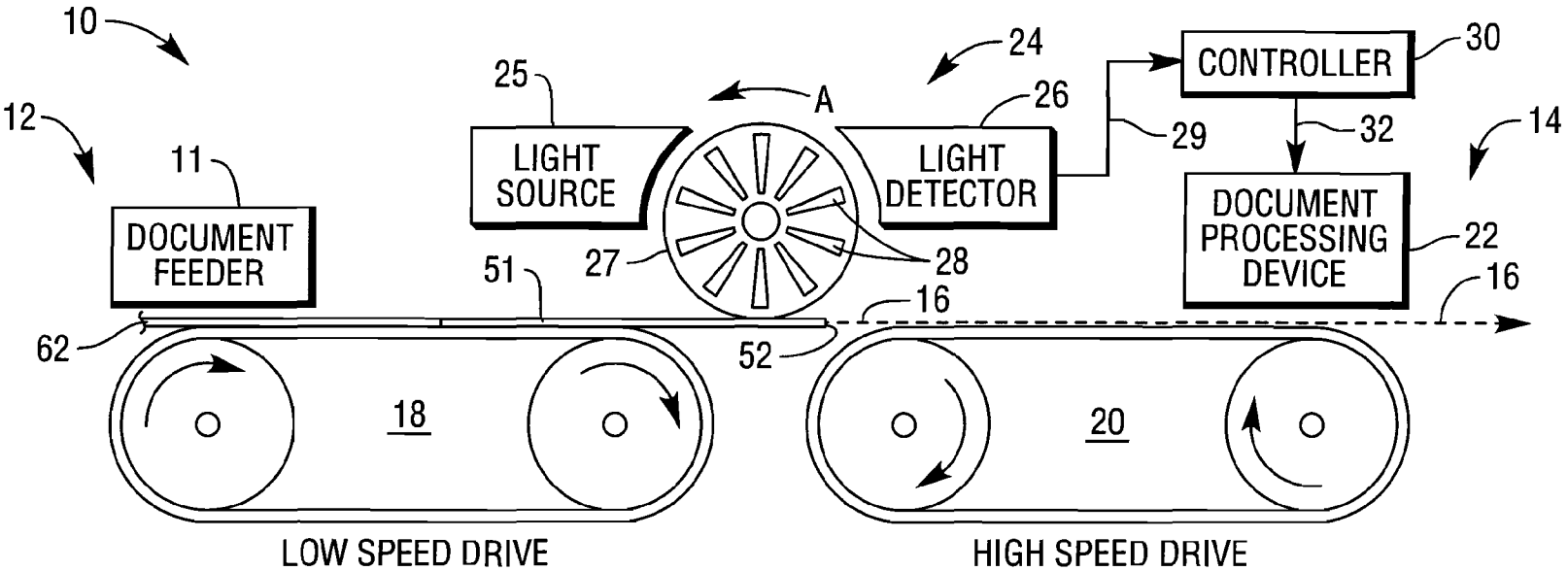

Typical operation of the document processing apparatus 10 is described herein. As the first document 51 shown in FIG. 1 moves downstream along the document transport path 16, leading edge 52 of the first document eventually reaches and engages the outer circumferential surface of the optical wheel 27 as shown in FIG. 2. As the leading edge 52 of the first document 51 engages the outer circumferential surface of the optical wheel 27, the optical wheel begins to rotate about its longitudinal central axis in the direction of arrow "A" shown in FIG. 2. Due to continued downstream movement of the first document 51 from the position shown in FIG. 2 to a position such as shown in FIG. 3, the sensor 24 provides the first electrical signal on line 29 which indicative of the speed of movement of the first document along the document transport path 16. The speed of movement of the first document 51 shown in FIGS. 2 and 3 is at a relatively lower speed as a result of being driven by the low speed drive 18.

Figure 4:
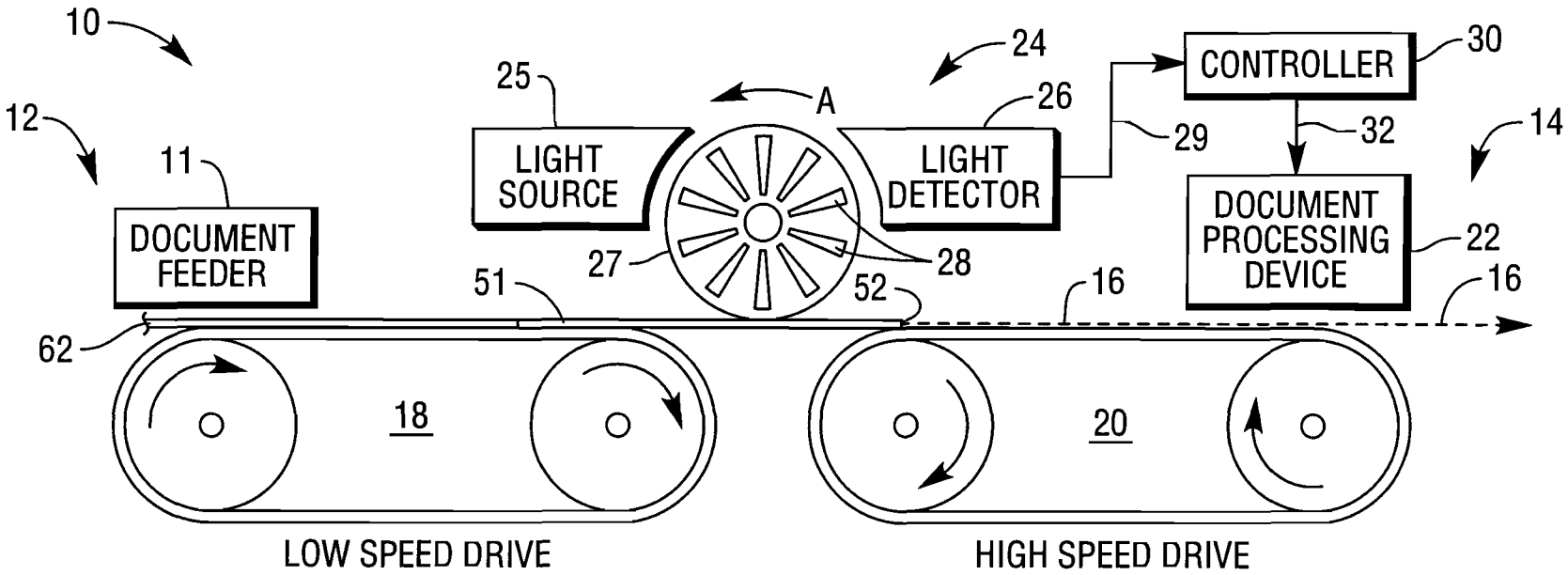

As the first document 51 shown in FIG. 3 continues to move downstream along the document transport path 16, the leading edge 52 of the first document eventually reaches and engages the high speed drive 20 as shown in FIG. 4. As the leading edge 52 of the first document 51 engages the high speed drive 20, the first document continues to move downstream at the relatively lower speed of the low speed drive 18.

Figure 5:
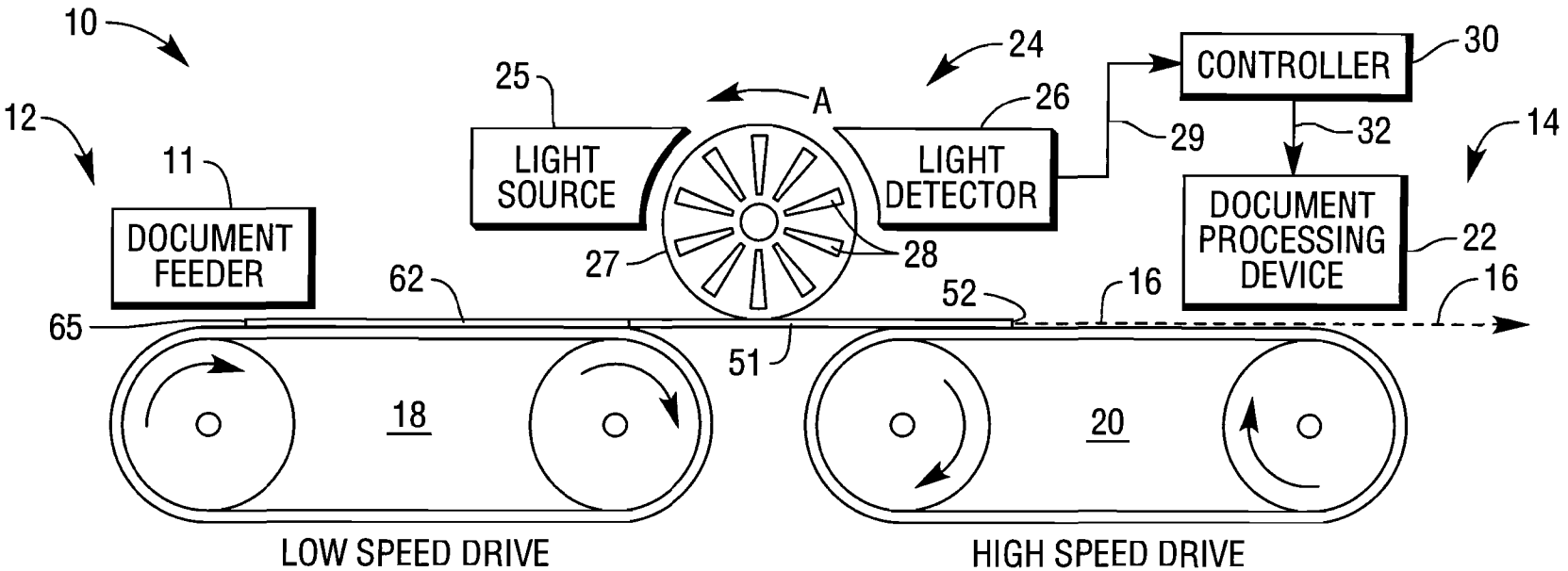

Since belts of the low speed drive 18 have a relatively higher coefficient of friction than coefficient of friction of belts of the high speed drive 20, the first document 51 continues to move downstream at the relatively lower speed until trailing edge 54 of the first document 51 just disengages from the low speed drive 18 as shown in FIG. 5. When this disengagement occurs, the first document 51 is free of the low speed drive 18. At the moment of disengagement, the first electrical signal on line 29 from the sensor 24 changes from an indication of the relatively lower speed to an indication of the relatively higher speed. In response thereto, the controller 30 immediately provides the second electrical signal on line 32 to actuate the downstream-located document processing device 22 so that the device can immediately begin its operation (such as document alignment) on the first document 51.

Figure 6:
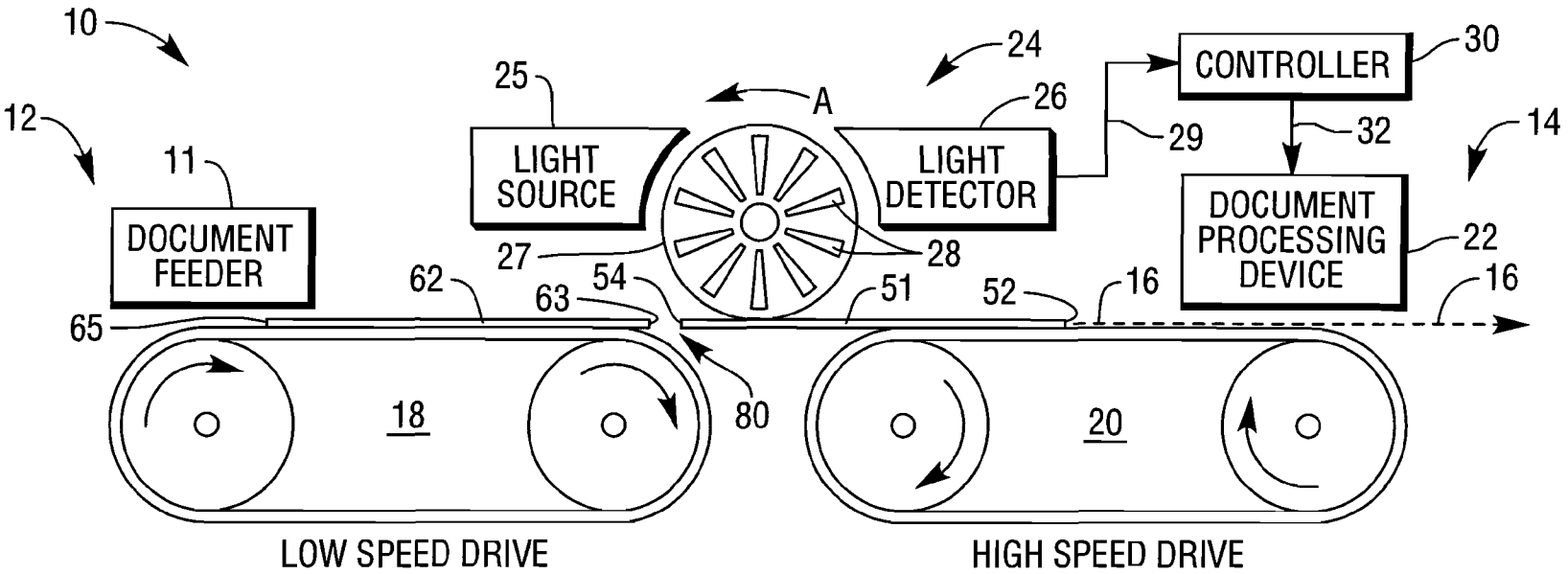
Figure 7:
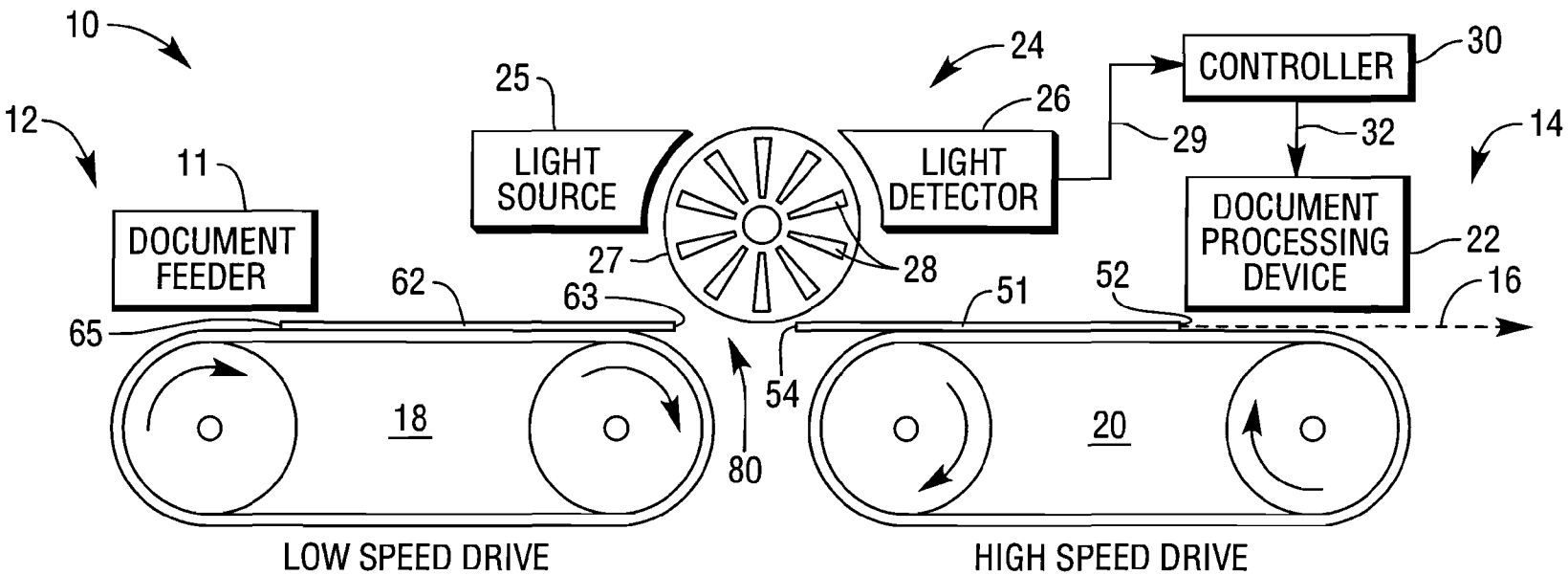
Figure 8:
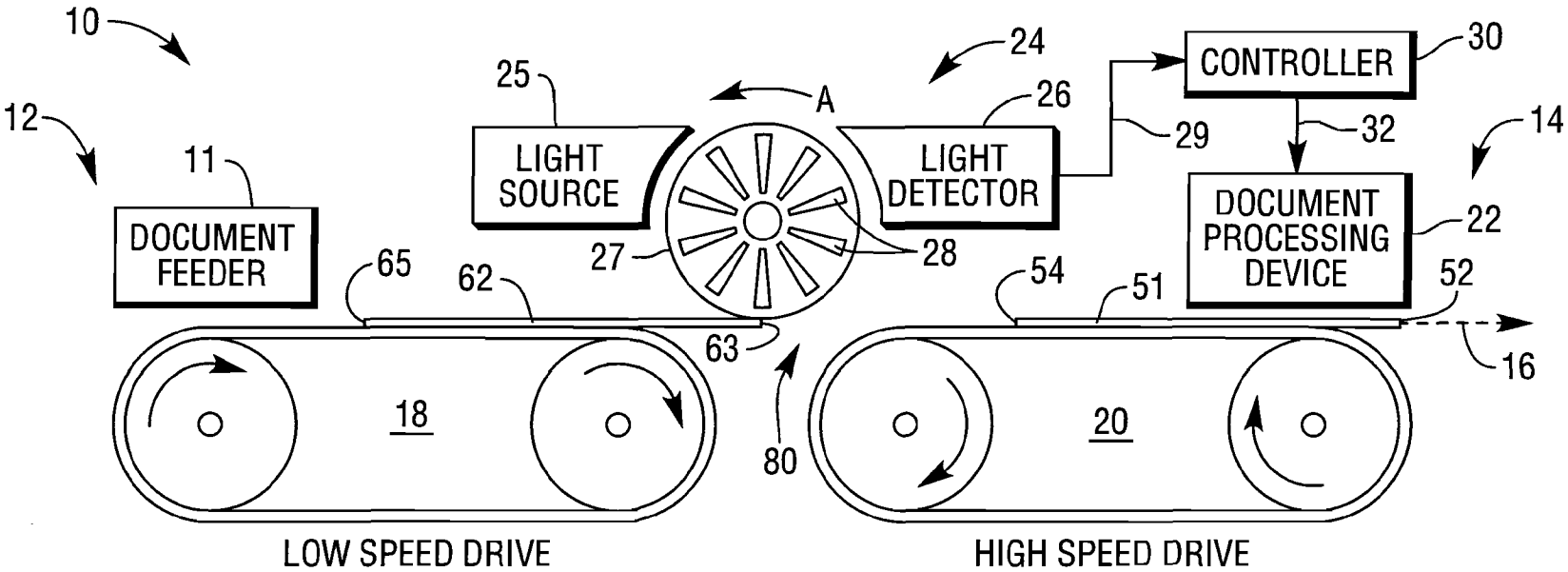

As the first document 51 continues to move faster downstream, a gap 80 (as shown in FIG. 6) begins to form between trailing edge 54 of the first document and leading edge 63 of the second document 62. Due to continued downstream movement of the first document 51 at the relatively higher speed from the position shown in FIG. 6 to a position such as shown in FIG. 7, the gap 80 as shown in FIG. 7 is now larger than as shown in FIG. 6. As the first document 51 continues to move downstream from the position shown in FIG. 7 to a position such as shown in FIG. 8, the gap 80 continues to become larger. The gap 80 will continue to become larger until trailing edge 65 of the second document 62 disengages the low speed drive 18. At this time, the trailing edge 65 of the second document 62 begins to move away from leading edge of the next adjacent document (not shown) in the same manner as just described hereinabove for the first and second documents 51, 62.

It should be apparent that when the sensor 24 provides the first electrical signal on line 29 which is indicative of a change in speed of the first document 51 being fed along the document transport path 16, this is indicative of the moment the first document has just disengaged from the low speed drive 18 and is now free of the low speed drive 18. Upon detecting the first electrical signal being provided, the controller 30 immediately provides the second electrical signal on line 32 to actuate the downstream-located document processing device 22 so that the device can immediately begin processing the first document 51 which is being transported along the document transport path 16. Accordingly, operation of the document speed sensor 24 in cooperation with the controller 30 described hereinabove enables a speed change of a document being fed along the document transport path 16 to be detected and immediately acted upon in response to a speed change of the document being detected. This cooperation of the sensor 24 and the controller 30 eliminates need for detecting when a gap of at least a certain size has been created between the trailing edge of the leading document and the leading edge of the trailing document which is just right behind along the document transport path 16.

Further, it should be apparent that the second electrical signal on line 32 from the controller 30 suddenly changes state when the speed of movement of the first document 51 suddenly increases from the relatively lower speed to the relatively higher speed upon disengagement of the trailing edge 54 of the first document 51 from the low speed drive 18.

This sudden change of state of the second electrical signal on line 32 indicates a momentary acceleration of the first document 51 when it suddenly increases from the relatively lower speed to the relatively higher speed. The second electrical signal on line 32 may suddenly change from a relatively low value to a relative high value to signal the downstream-located document processing device 22 to begin its operation. Alternatively, the second electrical signal on line 32 may suddenly change from a relatively high value to a relative low value to signal the downstream-located document processing device 22 to begin its operation.

Also, it should be apparent that no gap is even needed between adjacent documents. Since no gap is even needed between adjacent documents, the length of the document transport path 16 required to process documents may be reduced. The result is that the size of the document processing apparatus 10 may be made more compact.

The particular arrangements disclosed are meant to be illustrative only and not limiting as to the scope of the invention. From the above description, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A method of operating a document processing apparatus having a document transport path which extends from an upstream end to a downstream end, the method comprising:

sensing speed of movement of a document which is being transported along the document transport path from the upstream end to the downstream end, including engaging a major surface of the document by a sensor located between an upstream document drive located at the upstream end and a downstream document drive located at the downstream end;

detecting a first speed of movement of the document by the sensor after the major surface of the document has made contact with the upstream document drive and as a leading edge of the document is reaching the sensor;

detecting a second speed of movement of the document by the sensor after the major surface of the document has made contact with the downstream document drive and as a trailing edge of the document is leaving the upstream document drive;

determining that speed of movement of the document along the document transport path has increased from the first speed to the second speed which is greater than the first speed; and upon determining the speed of movement of the document increasing from the first speed to the second speed, actuating a downstream-located processing device to begin operating and thereby to begin further downstream processing of the document being transported along the document transport path.

2. A method according to claim 1, wherein actuating a downstream-located processing device comprises actuating an aligning device to begin alignment of the document being transported along the document transport path.

3. A document processing apparatus comprising:

a document transport path which extends from an upstream end to a downstream end;

a low speed drive disposed at the upstream end of the document transport path and for transporting a document along the document transport path from the upstream end towards the downstream end;

a high speed drive disposed at the downstream end of the document transport path and for receiving a document being transported along the document transport path from the low speed drive;

an actuatable document processing device disposed at the downstream end of the document transport path and for, when actuated, performing a downstream processing operation on a document being transported along the document transport path;

a sensor disposed between the low speed drive disposed at the upstream end and the high speed drive disposed at the downstream end for engaging a major surface of the document and for (i) sensing speed of movement of a document which is being transported along the document transport path from the upstream end to the downstream end, (ii) providing a first electrical signal which is indicative of a first speed of movement of the document after the major surface of the document has made contact with the low speed drive and as a leading edge of the document is reaching the sensor, and (iii) providing a second electrical signal which is indicative of a second speed of movement of the document greater than the first speed after the major surface of the document has made contact with the high speed drive and as a trailing edge of the document is leaving the low speed drive; and a controller for (i) monitoring the first and second electrical signals to thereby monitor speed of movement of the document along the document transport path, (ii) determining that speed of movement of the document has increased from the first speed to the second speed, and (iii) providing a second electrical signal to actuate the document processing device to perform the downstream processing operation in response to determining the speed of movement of the document having increased from the first speed to the second speed.

4. A document processing apparatus according to claim 3, wherein the sensor comprises (i) a light source, (ii) a light detector, and (iii) an optical wheel having slits through which light from the light source can be transmitted and detected as light pulses by the light detector.

5. A document processing apparatus according to claim 4, wherein the actuatable document processing device comprises an actuatable aligning device which, when actuated, begins alignment of the document being transported along the document transport path.

6. A document processing apparatus comprising:

a document transport path which extends from an upstream end to a downstream end;

a low speed drive disposed at the upstream end of the document transport path and for transporting a document along the document transport path from the upstream end towards the downstream end;

a high speed drive disposed at the downstream end of the document transport path and for receiving a document being transported along the document transport path from the low speed drive;

an actuatable document processing device disposed at the downstream end of the document transport path and for, when actuated, performing a downstream processing operation on a document being transported along the document transport path;

a sensor disposed between the low speed drive disposed at the upstream end and the high speed drive disposed at the downstream end for engaging a major surface of the document and for (i) sensing speed of a document which is being transported along the document transport path from the upstream end to the downstream end, (ii) providing a first electrical signal which is indicative of a first speed of the document after the major surface of the document has made contact with the low speed drive and as a leading edge of the document is reaching the sensor, and (iii) providing a second electrical signal which is indicative of a second speed of movement of the document greater than the first speed after the major surface of the document has made contact with the high speed drive and as a trailing edge of the document is leaving the low speed drive; and a controller for (i) monitoring the first and second electrical signals to thereby monitor speed of the document along the document transport path, (ii) determining that speed of the document has suddenly increased from the first speed to the second speed, and (iii) providing a second electrical signal to actuate the document processing device to perform a downstream processing operation in response to when the speed of the document has suddenly increased from the first speed to the second speed.

7. A document processing apparatus according to claim 6, wherein the second electrical signal suddenly changes from a first value to a second value greater than the first value in response to when speed of the document has suddenly increased from the first speed to the second speed.

8. A document processing apparatus according to claim 6, wherein the second electrical signal suddenly changes from a first value to a second value less than the first value in response to when speed of the document has suddenly increased from the first speed to the second speed.

9. A document processing apparatus according to claim 6, wherein the sensor comprises (i) a light source, (ii) a light detector, and (iii) an optical wheel having slits through which light from the light source can be transmitted and detected as light pulses by the light detector.

10. A document processing apparatus according to claim 6, wherein the actuatable document processing device comprises an actuatable aligning device which, when actuated, begins alignment of the document being transported along the document transport path.

* * * * *